US006672291B2

(12) United States Patent
Balsdon et al.

(10) Patent No.: US 6,672,291 B2
(45) Date of Patent: Jan. 6, 2004

(54) PURGE VALVE WITH EVALUATION PORT

(75) Inventors: David W. Balsdon, Chatham (CA); Alfred Schneider, Blenhiem (CA)

(73) Assignee: Siemens Automotive Inc. (CA)

( * ) Notice: Subject to any disclaimer, the term of this patent is extended or adjusted under 35 U.S.C. 154(b) by 0 days.

(21) Appl. No.: 09/995,788

(22) Filed: Nov. 29, 2001

(65) Prior Publication Data

US 2002/0096153 A1 Jul. 25, 2002

Related U.S. Application Data

(60) Provisional application No. 60/253,856, filed on Nov. 29, 2000.

(51) Int. Cl.[7] ..... F02M 37/04

(52) U.S. Cl. ..... 123/519; 73/117.3; 123/520; 137/557

(58) Field of Search ..... 123/516, 518, 123/519, 520; 137/557; 73/118.1, 117.3

(56) References Cited

U.S. PATENT DOCUMENTS

| | | | | | |
|---|---|---|---|---|---|
| 3,703,165 | A | | 11/1972 | Hansen | 123/136 |
| 3,752,134 | A | | 8/1973 | Hollins, Jr. | 123/136 |
| 4,566,423 | A | | 1/1986 | Kenny et al. | 123/571 |
| 4,944,276 | A | | 7/1990 | House et al. | 123/520 |
| 5,183,022 | A | | 2/1993 | Cook | 123/520 |
| 5,386,812 | A | * | 2/1995 | Curran et al. | 123/520 |
| 5,427,076 | A | * | 6/1995 | Kobayashi et al. | 123/520 |
| 5,845,625 | A | | 12/1998 | Kidokoro et al. | 123/520 |
| 5,878,725 | A | * | 3/1999 | Osterbrink | 123/516 |
| 5,878,729 | A | | 3/1999 | Covert et al. | 123/520 |
| 5,890,474 | A | | 4/1999 | Schnaibel et al. | 123/520 |
| 5,898,108 | A | * | 4/1999 | Mieczkowski et al. | 73/118.1 |
| 6,247,456 | B1 | | 6/2001 | Everingham et al. | 123/520 |

FOREIGN PATENT DOCUMENTS

| | | |
|---|---|---|
| EP | 1 158 157 | 11/2001 |
| JP | 11 82187 | 3/1999 |

OTHER PUBLICATIONS

U.S. Patent Appln. No. 09/995,787, David W. Balsdon, et al., filed Nov. 29, 2001.

* cited by examiner

*Primary Examiner*—Thomas N. Moulis

(57) ABSTRACT

A vapor purge system that permits evaluation of the system with a minimum number of hoses and connections, and without the use of additional components. The system includes a valve having first and second ports in communication with a first chamber and a third port in communication with a second chamber, the first and second chambers being defined by a metering member that divides an internal volume of a housing. A first conduit connects a diagnostic member having first and second operative states with the first chamber, the connection being made through the second port. The first operative state prohibits communication with an exterior of the valve, and the second operative state permits communication with the exterior. The diagnostic member provides the ability to reliably measure flow through the valve. The system can use three (3) hoses including five (5) connections from a vapor supply port connected with the first port to the third port operatively connected with a manifold.

42 Claims, 5 Drawing Sheets

PURGE VALVE WITH EVALUATION PORT

CLAIM FOR PRIORITY

This application claims priority to U.S. provisional application No. 60/253,856 entitled "Integrated Purge Valve and Diagnostic member", filed Nov. 29, 2000, which is incorporated by reference herein in its entirety.

CROSS-REFERENCE TO RELATED APPLICATION

This application is related in subject matter to co-pending application no. (Attorney Docket No. 051481-5102), entitled "Purge Valve With Integral Diagnostic Member," filed on the even date.

BACKGROUND OF THE INVENTION

The present invention relates to a vapor purge system, and more particularly to a purge system including a valve that provides a reliable measure of flow through the valve.

In a system that is known to Applicants, a valve is used to deliver fuel vapor to an engine intake manifold for use in a combustion process.

In the known system, a fuel tank is in fluid communication with a charcoal canister, such that the charcoal canister receives vaporized fuel from the tank. The collected vapor is delivered from the canister through a delivery port. The valve includes an input and an output, the input being in fluid communication with the delivery port.

The diagnosis and evaluation of flow through the known system is achieved between the delivery port and the inlet port of the valve. In particular, a t-fitting is disposed between the delivery port and the valve. Thus, a direct flow path between the delivery port and the valve is split by the t-fitting, the direct flow path replaced by three flow paths, in particular (1) a flow path from the delivery port to a first arm of the t-fitting, (2) a flow path from the second arm that permits evaluation of the system, and (3) a flow path from the third arm of the t-fitting to the valve for delivery. Diagnosis and testing of the flow diverted through the second arm of the t-fitting is accomplished through a testing member. The flow paths are fuel grade hoses.

A fourth flow path, also in the form of a fuel grade hose, is used to deliver fuel vapor from the valve (i.e., from the valve output) to the engine intake manifold for combustion.

Thus, from the delivery port to the valve output of the known system, four hoses and seven connections are required. The seven connections are as follows: (1) at the vapor delivery port, (2) at the first arm of the t-fitting, (3) at the second arm of the t-fitting, (4) at the third arm of the t-fitting, (5) at the testing member, (6) at the inlet port of the valve, and (7) at the outlet port of the valve.

Multiple separate brackets are used to mount the valve and the testing member with the motor vehicle chassis.

The known system suffers from a number of disadvantages, in that each hose, connection, and additional, separate component (e.g., the t-fitting) increases the cost and the complexity of the system. Further, each additional connection provides an additional potential leak point within the system. Because vapor can leak from the system between the flow evaluation point and the valve, testing to determine flow through the valve becomes less accurate as the number of leak points increases between the evaluation point and the valve. A multiplicity of brackets for mounting of the valve and the testing member also increases the complexity and the cost of assembly of the known system.

SUMMARY OF THE INVENTION

The present invention provides a vapor purge system that permits evaluation of the system with a minimum number of hoses and connections, and without the use of additional components. The system includes a valve having first and second ports in communication with a first chamber and a third port in communication with a second chamber, the first and second chambers being defined by a metering member that divides an internal volume of a housing. A first conduit connects a diagnostic member having first and second operative states with the first chamber, the connection being made through the second port. The first operative state prohibits communication with an exterior of the valve, and the second operative state permits communication with the exterior. The diagnostic member provides the ability to reliably measure flow through the valve. The system can use three (3) hoses including five (5) connections from a vapor supply port connected with the first port to the third port operatively connected with a manifold.

The present invention also provides an evaluation assembly. A valve includes a housing defining an internal volume. A metering member is disposed in the housing, the metering member dividing the internal volume into first and second chambers. A first port is in communication with the first chamber. A second port is in communication with the first chamber. A third port is in communication with the second chamber. A first conduit provides a flow path from the second port to a diagnostic member. The diagnostic member provides the ability to reliably measure flow through the valve.

The present invention also provides a method of evaluating a vapor purge system having a vapor collection arrangement, a valve, and a diagnostic member. The valve includes a housing defining an internal volume, a metering member disposed in the housing to divide the volume into first and second chambers, a first port in communication with the first chamber, a second port in communication with the first chamber, and a third port in communication with the second chamber. The diagnostic member is in communication with the second port, the diagnostic member having a first operative state that prohibits communication with an exterior of the valve and a second operative state that permits communication with the exterior. A conduit provides a flow path from the second port to the diagnostic member. The method includes locating the diagnostic member above a top-most surface of the valve, sealing the first chamber from the second chamber with the metering member, and measuring a flow through the first chamber of the valve.

BRIEF DESCRIPTIONS OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
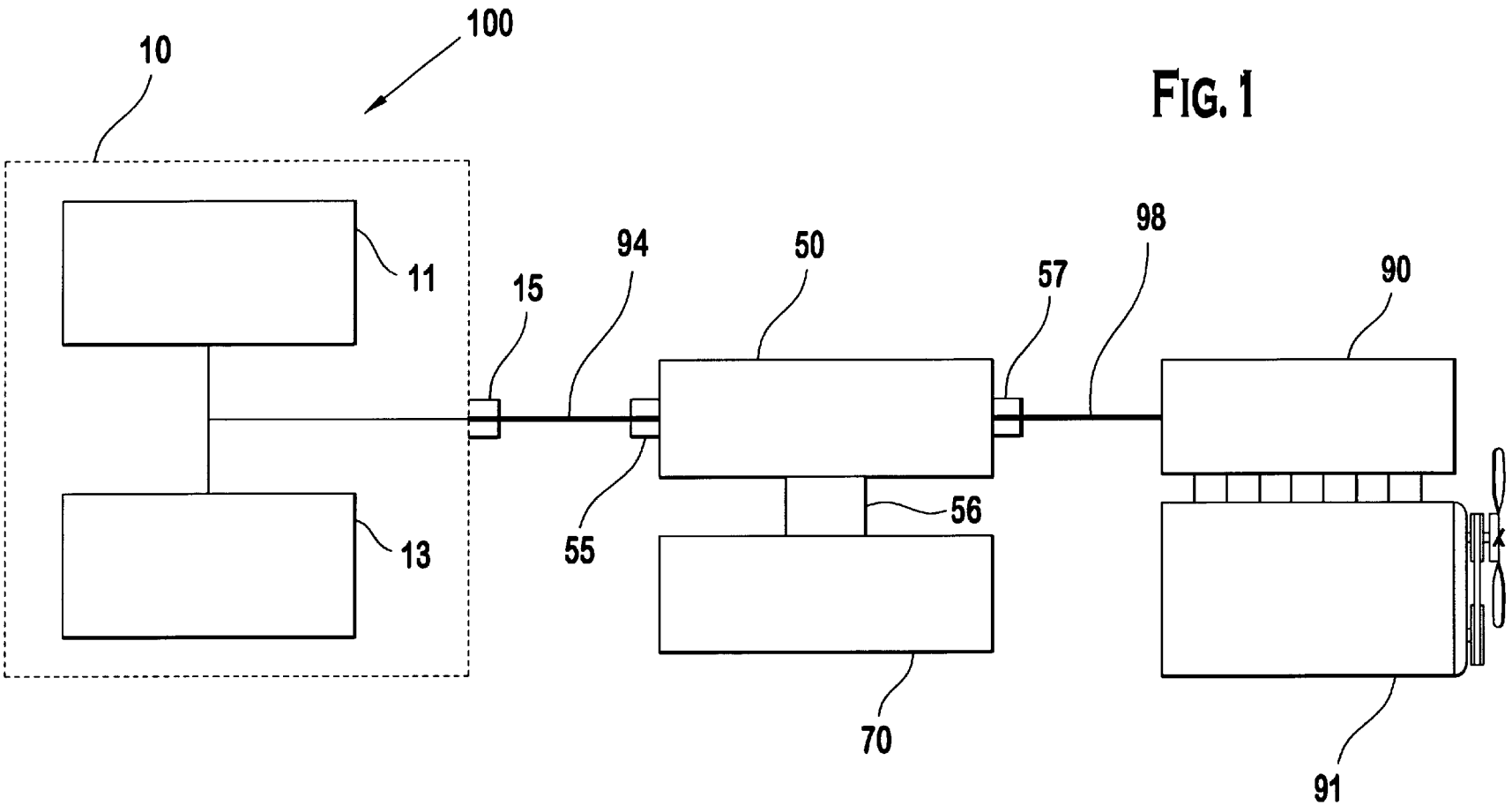
FIG. 1 shows a schematic representation of a vapor purge system.

The figures show a vapor purge system 100 that permits evaluation of the system with a minimum number of hoses and connections, and without the use of additional components. The vapor purge system includes a tank-canister arrangement 10, a valve 50, a diagnostic member 70, a manifold 90, and an engine 91, in communication, such that fuel vapor collected in the tank-canister arrangement 10 is delivered to the engine 91 for use in a combustion process. It is to be understood that each of the components in the vapor purge system 100 can be connected and sealed in a manner that permits delivery of fuel vapor from the tank-canister arrangement 10 to the manifold 90, and testing and evaluation of the purge system 100.

The tank-canister arrangement 10 delivers vaporized fuel to the valve 50. A fuel tank 11 receives and stores liquid fuel, and includes an upper portion or head space to collect fuel vapor that is released from liquid fuel stored in a lower portion of the tank 11.

A charcoal canister 13 receives and collects the fuel vapor from the tank 11, and delivers the vaporized fuel to the valve 50. A vapor conduit, which is preferably a fuel grade hose, is provided between the tank 11 and the canister 13. Each of the fuel grade hoses within the purge system 100 can be attached by crimping, clamping, or on barbed features of the components.

The tank-canister arrangement 10 includes a vapor supply port 15 for delivering the collected fuel vapor to an internal chamber of the valve 50, the flow rate through the valve 50 being determined directly from the internal chamber. Thus, a reliable measurement of flow through the valve 50 is achieved.

The vapor supply port 15 delivers the collected fuel vapor to the internal chamber of the valve 50 through a second vapor conduit. As shown in the drawings, the second vapor conduit can be achieved through the use of a t-fitting disposed in communication with the vapor conduit, or alternatively, the second vapor connection can be achieved from the canister 13. Preferably, the second vapor conduit includes one or more fuel grade hoses. It is to be understood, however, that the second vapor connection can be any connection, so long as the connection delivers the collected fuel vapor to the vapor supply port 15.

A first connection 94 delivers fuel vapor from the vapor supply port 15 to the internal chamber of the valve 50, the flow rate through the valve 50 being determined directly from the chamber. In a preferred embodiment, the first connection 94 delivers fuel vapor to one of two internal chambers of the valve 50 for testing, and more preferably, to a port of the valve 50 which is in fluid communication with the one of the two internal chambers.

As discussed above, the valve 50 permits testing and evaluation of flow directly from the internal chamber. In a preferred embodiment, the valve 50 includes a housing 51 defining an internal volume. A metering member 52 is disposed in the housing 51, the metering member 52 dividing the internal volume into first and second chambers. The operating characteristics of the metering member 52 that provide for flow through the valve 50 are discussed in U.S. Pat. No. 6,247,456 to Everingham et al., which is incorporated by reference herein in its entirety.

The housing 51 includes an upper housing portion 51*a* and a lower housing portion 51*b*. The metering member 52 includes a pintle 53 and a seat 54. The metering member 52 is positionable to permit and prohibit flow between the first and second chambers. Although the figures illustrate a preferred embodiment of the metering member 52, it is to be understood that the metering member can be any suitable device that permits and prohibits flow through the valve and maintains a division between two internal chambers.

The upper and lower housing portions 51*a*, 51*b* are preferably an upper cap and a body, respectively, the upper cap snapped onto the body that captures the metering member 52 and includes a wall that forms the valve ports. Preferably, the housing portions are formed of a plastic material, and the ports are molded into the lower housing portion 51*b*. However, it is to be understood that the housing portions can be any material, so long as the material is suitable for use in a fuel vapor purge environment.

In a specific preferred embodiment, the valve 50 includes first and second ports 55, 56 that are in fluid communication with the first internal chamber, and a third port 57 that is in fluid communication with the second internal chamber. The second port 56 permits reliable measurement of the purge flow rate through the valve because the second port 56 is in fluid communication with the first chamber. The first port 55 receives fuel vapor from the vapor supply port 15, the fuel vapor flowing through the first connection 94. The third port 57 delivers the fuel vapor to the intake manifold 90 for use in the combustion process.

The second port 56 extends from the lower housing 51*b*, and is disposed about 180 degrees from the first port 55 and the third port 57 in a preferred configuration, and, more preferably, is disposed at an elevation that is about the same as an elevation of the first port 55. The lower housing portion 51*b* preferably forms the second port 56, and, more preferably, forms each of the first, second, and third ports 55–57, respectively.

The first connection 94 is preferably a fluid grade hose, and, more preferably, the hose includes first and second ends, the first end connected with the vapor supply port 15 and the second end connected with the first port 55. Thus, the vapor control system 100 can have a single hose with two connections from the vapor supply port 15 to the valve 50. It is to be understood, however, that the first connection 94 can be any collection of components, so long as the first connection 94 delivers fuel vapor from the vapor supply port 15 to the valve 50, such that operation and testing of the vapor purge system 100 can be achieved.

Figure 2:
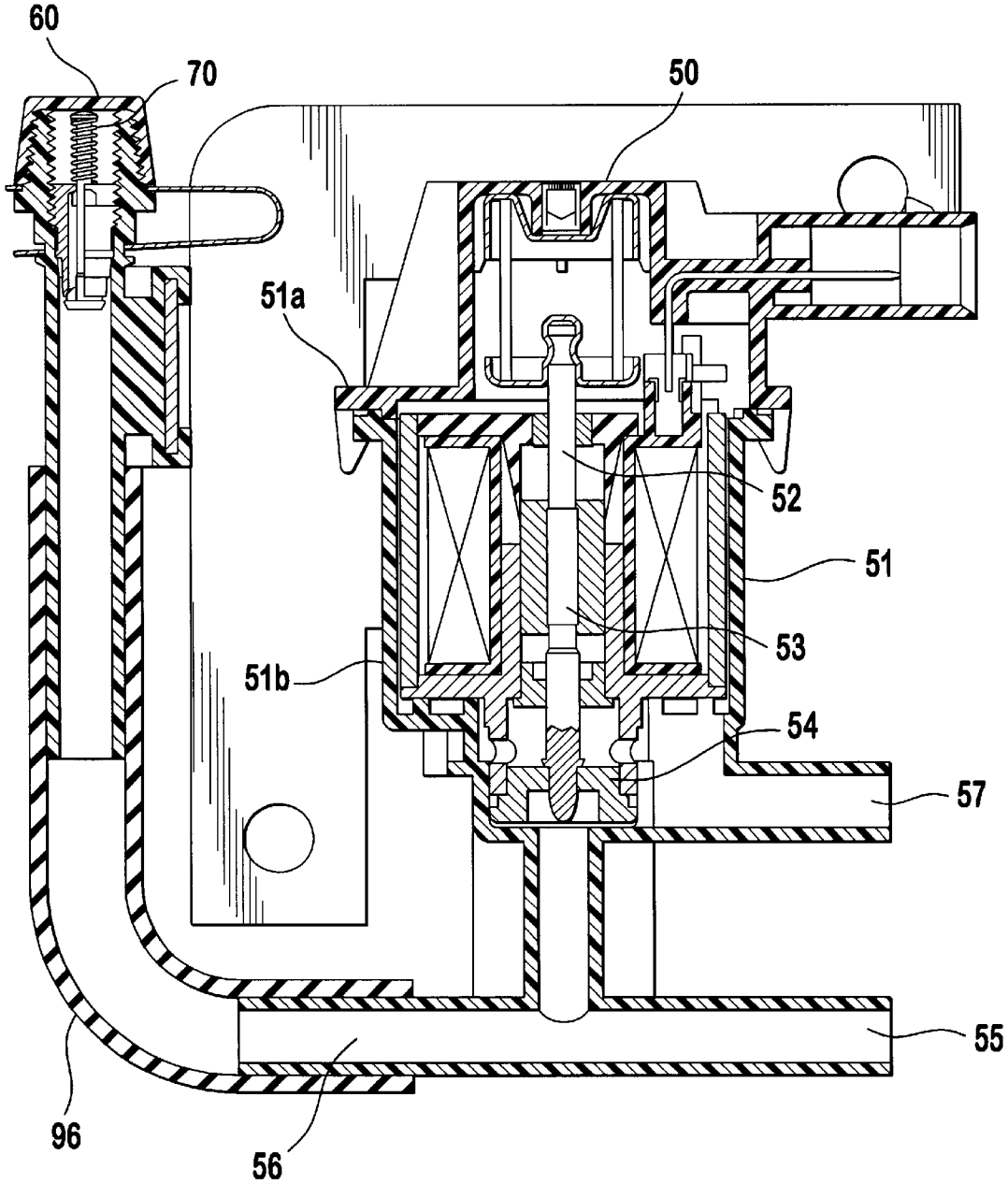
FIG. 2 shows an isometric view of a valve according to the invention.
Figure 3:
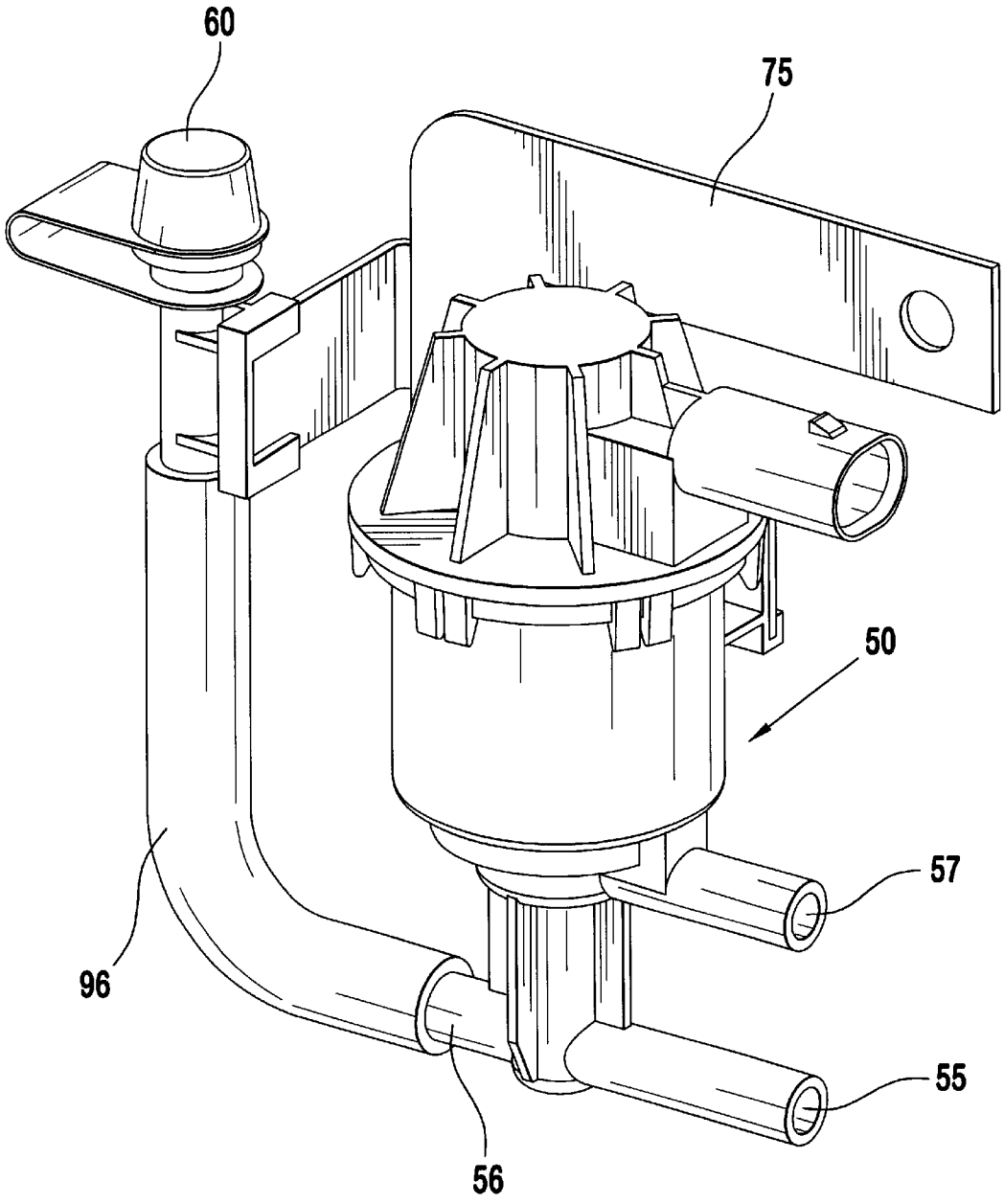
FIG. 3 shows a cross-sectional view of the valve of FIG. 2.

The diagnostic member 70 can be any member, such as a removable plug, a porous member, or a valve, and preferably, is a check valve, that permits testing and evaluation by permitting flow to the exterior of the valve 50. The diagnostic member 70 has first and second operative states, the first operative state prohibiting communication with the exterior of the valve, and the second operative state permitting communication with the exterior. In a preferred embodiment, the diagnostic member 70 is in fluid communication with the second port 56, and, more preferably, is fluidly connected with and disposed apart from the second port 56. In a preferred embodiment, the diagnostic member 70 is disposed above the valve 50, and, more preferably, as shown in FIG. 2, the diagnostic member 70 includes at least a portion that is disposed above the valve 50. However, any portion of the diagnostic member 50 can be disposed above or below the top-surface of the valve 50. It is to be understood that the diagnostic member 70 can be any member that permits and prohibits flow the internal chamber to the exterior of the valve 50, and can be disposed at any location relative to the valve 50, so long as testing and evaluation of the flow directly from the internal chamber of the purge vale 50 can be achieved.

The diagnostic member 70 can have an end that includes an enlarged diameter portion with an external thread disposed thereon. A cap 60 with a cooperatively engaging internal thread can be removably disposed on the diagnostic member 70, the cap 60 being removed to permit evaluation of the purge system 100 through the diagnostic member 70, and replaced after testing to prevent contamination of the internal valve chambers. The cap 60 includes a retention portion that connects with the diagnostic member 70 to prevent misplacement. The cap 60 includes a number of parallel grooves which aid in its manipulation.

A second connection 96 delivers fuel vapor from the purge valve 50 (i.e., the second port 56) to the diagnostic member 70. In a preferred embodiment, the second connection 96 is a fuel grade hose, and, more preferably, the hose includes first and second ends, the first end connected with the purge valve 50, and the second end connected with the diagnostic member 70. By this arrangement, a purge system 100 can have a single hose with two connections from the valve 50 to the diagnostic member 70.

Evaluation of the purge flow rate in the canister side of the vapor purge system 100 can be accomplished by measuring the flow rate directly from the internal chamber through the diagnostic member 70. In a preferred evaluation method, the cap 60 is removed from the diagnostic member 70, and a flow rate sensor or flow meter is connected thereto. The system 100 is evaluated under predetermined operating conditions over a predetermined time interval. The measured flow rates are compared to predetermined values to determine whether a leak is present. Because the diagnostic member 70 is in fluid communication with the first chamber of the valve 50, a reliable evaluation of the purge flow rate through the valve 50 is achieved.

A third connection 98 delivers fuel vapor from the output of the valve (i.e., the third port 57) for use in the combustion process of the internal combustion engine (e.g., to an intake manifold). In a preferred embodiment, the third connection 98 is a fuel grade hose, and, more preferably, the hose includes first and second ends, the first end connected with the valve 50, and the second end operatively connected with the manifold 90. The second end can be directly connected with the manifold 90, or alternatively, can be connected with the manifold 90 through one or more intervening member. By this arrangement, a purge system 100 can have a single hose with one connections from the valve 50. It is to be understood, however, that the third connection 98 can be any collection of components, so long as the third connection 98 is adapted to deliver fuel vapor from the vapor valve 50 for use in the combustion process, such that operation and testing of the vapor purge system 100 can be achieved.

The intake manifold 90 receives the fuel vapor from the third port 57 of the valve 50, and delivers the fuel vapor to the engine 91. The engine 91 consumes the fuel vapor in the combustion process.

Thus, the preferred embodiment of the vapor purge system 100 that provides for flow diagnosis employs only three (3) hoses and five (5) connections from the vapor delivery port 15 to the output of the valve 50 (i.e., the third port 57). The preferred embodiment includes one (1) less hose and two (2) less connections than the known system discussed above that includes a testing member in conjunction with a t-fitting. The evaluation and diagnosis of the purge flow on the canister side of the system 100 is reliably achieved because the flow measurements are taken directly from the first chamber of the valve 50.

A mounting bracket 75 mounts the diagnostic member 70 and the valve 50 to the chassis of the motor vehicle. In a preferred embodiment, the mounting bracket includes first, second, third and fourth portions, 75*a*–75*d*, respectively. The first, second, and third portions 75*a*–75*c* extend in about perpendicular to a longitudinal axis of the valve 50 (i.e., along a diameter of the valve). These three portions are connected to the fourth portion 75*d* that extends in a second direction along the longitudinal axis of the valve 50 (i.e., 90 degrees from the first portion). The first portion 75*a* secures to the valve housing 51, and the second portion secures to the diagnostic member 70.

Figure 4:
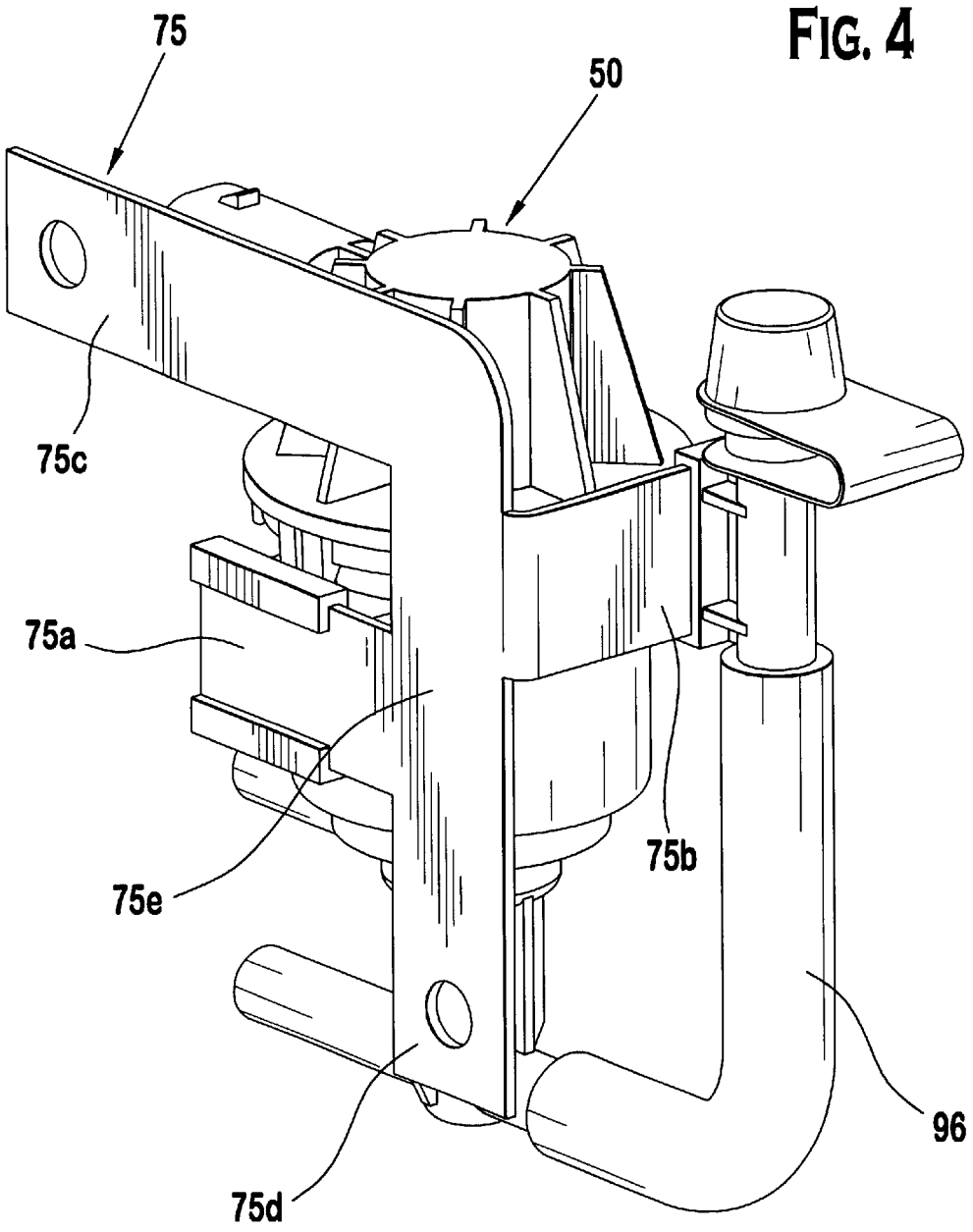
FIG. 4 shows a rear isometric view of the valve of FIG. 2.
Figure 5:
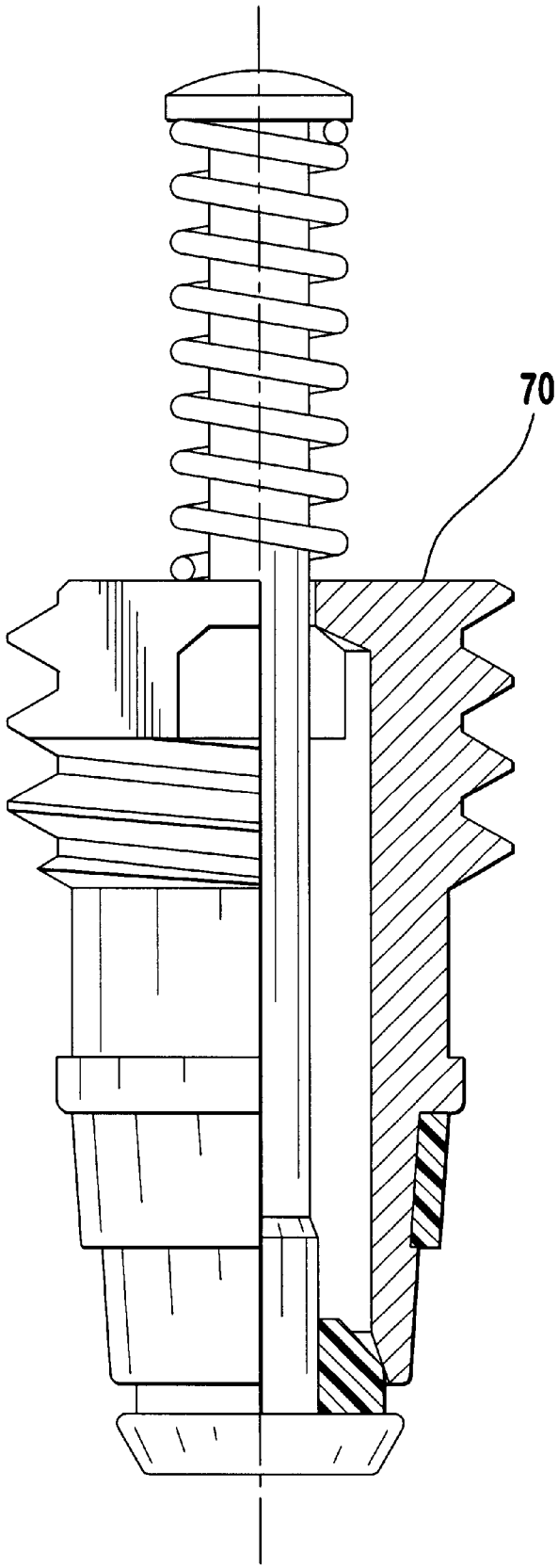
FIG. 5 shows an enlarged cross-sectional view of the diagnostic member of FIG. 2.

As shown in FIG. 4, the second portion 75*b* is disposed proximate a top of the fourth portion 75*d*, such that the diagnostic member 70 can be more easily accessed within an engine compartment of a motor vehicle during evaluation of the system 100. Specifically, the second portion 75*b* locates the diagnostic member 70 above a topmost surface of the valve 50. The bracket 75 for mounting both the valve 50 and the diagnostic member 70 can be any shape, so long as the diagnostic member 70 is conveniently located relative to the valve 50. Although a preferred embodiment includes a single bracket 75 for the mounting of both the valve 50 and the diagnostic member 70, it is to be understood that a multiplicity of brackets can be used to mount these components to the motor vehicle chassis.

The housing 51 and diagnostic member 70 preferably include connecting portions, each connecting portion at least partially surrounding and achieving an interference fit with the first and second portions 75*a*, 75*b*, respectively. In a preferred embodiment, the first portion 75*a* is disposed at about 90 degrees to the second portion 75*b*, such that access to the diagnostic member is achieved. The bracket 75 further preferably includes a mounting portion 75*e* adapted for connection with a motor vehicle chassis.

As shown in FIG. 4, the first and third portions 75*a*, 75*c*, preferably extend in a direction that is parallel to the second port 56, and the second portion 75*b* extends in a direction that is about perpendicular to the second port 56. However, it is to be understood that the portions 75*a*–75*d* of the bracket 75 can be of any orientation that permits convenient mounting of the valve 50 and the diagnostic member 70 in an engine compartment of the motor vehicle and/or to the chassis.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A vapor purge system comprising:

a valve including a housing defining an internal volume, an electromagnetic coil disposed in the housing, the electromagnetic coil defining a hollow having a first end and a second end disposed along an axis, a metering member disposed in the housing, a movable member passing through the first end and the second end of the hollow, the metering member dividing the internal volume into first and second chambers, a first port in communication with the first chamber, a second port in communication with the first chamber, and a third port in communication with the second chamber;

a vapor supply port in communication with the first port;

a diagnostic member in communication with the second port and distally spaced from the hollow, the diagnostic member having a first operative state that prohibits communication with an exterior of the valve and a second operative state that permits communication with the exterior; and a first conduit providing a flow path from the second port to the diagnostic member.

2. The system according to claim 1, wherein the diagnostic member comprises a valve.

3. The system according to claim 2, wherein the valve comprises a check valve.

4. The system according to claim 3, wherein the first conduit comprises a hose having a first end and a second end, the first end connected with the second port and the second end connected with the diagnostic member.

5. The system according to claim 4, further comprising:

a second conduit providing a flow path from the vapor supply port to the first port.

6. The system according to claim 5, wherein the second conduit comprises a hose having a first end and a second end, the first end connected with the vapor supply port and the second end connected with the first port.

7. The system according to claim 1, further comprising:

a bracket including first and second portions, the first portion connected with the housing and the second portion connected with the diagnostic member, the second portion disposing the diagnostic member above an uppermost surface of the valve.

8. The system according to claim 7, wherein the bracket further comprises third and fourth portions, the first, second, and third portions extending in a first direction about perpendicular to a longitudinal axis of the purge valve and connected to the fourth portion, the fourth portion extending in a second direction along the longitudinal axis.

9. The system according to claim 8, further comprising:

a motor vehicle chassis, the bracket mounted to a first portion of the motor vehicle chassis.

10. The system according to claim 1, further comprising:

a second conduit providing a flow path between the vapor supply port and the first port; and a third conduit providing a flow path from the third port.

11. The system according to claim 10, further comprising:

a manifold adapted to receive fuel vapor for use in a combustion process, the manifold in communication with the third port.

12. The system according to claim 11, wherein the first conduit comprises a first hose having a first end and a second end, the first end of the first hose connected with the second port and the second end of the first hose connected with the diagnostic member.

13. The system according to claim 12, wherein the second conduit comprises a second hose having a first end and a second end, the first end of the second hose being connected with the vapor supply port and the second end of the second hose being connected with the first port, and the third conduit comprises a third hose having a first end and a second end, the first end of the third hose being connected with the third port and the second end of the third hose being operatively connected to the manifold.

14. The system according to claim 13, wherein the second end of the third hose is connected to the manifold.

15. The system according to claim 14, further comprising:

a bracket including first and second portions, the first portion connected with the housing and the second portion connected with the diagnostic member, the second portion disposing the diagnostic member above an uppermost surface of the valve.

16. The system according to claim 15, wherein the bracket further comprises third and fourth portions, the first, second, and third portions extending in a first direction about perpendicular to a longitudinal axis of the purge valve and connected to the fourth portion, the fourth portion extending in a second direction along the longitudinal axis.

17. The system according to claim 16, further comprising:

a tank adapted to store liquid fuel; and a canister in communication with the tank and the vapor supply port, the canister adapted to receive fuel vapor from the tank and to deliver the vapor to the vapor supply port.

18. The system according to claim 17, wherein the housing comprises upper and lower portions.

19. The system according to claim 18, wherein the lower portion defines the second port.

20. The system according to claim 19, wherein the lower portion defines the first, second, and third ports.

21. The system according to claim 20, wherein the upper and lower portions comprise a plastic material.

22. A flow evaluation assembly, comprising:

a valve including a housing defining an internal volume, an electromagnetic coil disposed in the housing, the electromagnetic coil defining a hollow having a first end and a second end disposed along an axis, a metering member disposed in the housing, a movable memeber passing through the first end and the second end of the hollow, the metering member dividing the internal volume into first and second chambers, a first port in communication with the first chamber, a second port in communication with the first chamber, and a third port in communication with the second chamber;

a diagnostic member in communication with the second port and distally spaced from the hollow, the diagnostic member having a first operative state that prohibits communication with an exterior of the valve and a second operative state that permits communication with the exterior; and a first conduit providing a flow path from the second port to the diagnostic member.

23. The assembly according to claim 22, wherein the diagnostic member comprises a valve.

24. The assembly according to claim 23, wherein the valve comprises a check valve.

25. The assembly according to claim 24, wherein the first conduit comprises a hose having first and second ends, the first end connected with the second port and the second end connected with the diagnostic member.

26. The assembly according to claim 25, further comprising:

a cap disposed on an end of the diagnostic member.

27. The assembly according to claim 26, wherein the housing comprises upper and lower portions.

28. The assembly according to claim 27, wherein the lower portion forms the second port.

29. The assembly according to claim 28, wherein the lower portion forms the first and second ports.

30. The assembly according to claim 22, further comprising:

a bracket including first and second portions, the first portion connected with the housing and the second portion connected with the diagnostic member, the second portion disposing the diagnostic member above a uppermost surface of the purge valve.

31. The assembly according to claim 30, wherein the bracket further comprises third and fourth portions, the first, second, and third portions extending in a first direction about perpendicular to a longitudinal axis of the purge valve and connected to the fourth portion, the fourth portion extending in a second direction along the longitudinal axis.

32. The assembly according to claim 31, wherein the housing includes a first connecting portion, the first connecting portion surrounding the first bracket portion.

33. The assembly according to claim 32, wherein the diagnostic member includes a second connecting portion, the second connecting portion surrounding the second bracket portion.

34. The assembly according to claim 33, wherein the first connecting portion achieves an interference fit with the first bracket portion.

35. The assembly according to claim 34, wherein the second connecting portion achieves an interference fit with the second bracket portion.

36. The assembly according to claim 35, wherein the first connecting portion is disposed at about 90 degrees to the second connecting portion.

37. The assembly according to claim 36, wherein the bracket further comprises a mounting portion adapted for connection with a motor vehicle chassis.

38. A method of evaluating a vapor purge system having a vapor collection arrangement and a valve that includes a housing defining an internal volume, an electromagnetic coil disposed in the housing, the electromagnetic coil defining a hollow having a first end and a second end disposed along an axis, a metering member disposed in the housing to divide the volume into first and second chambers, a movable member passing through the first end and the second end of the hollow, a first port in communication with the first chamber, a second port in communication with the first chamber, and a third port in communication with the second chamber, a diagnostic member in communication with the second port, the diagnostic member having a first operative state that prohibits communication with an exterior of the valve and a second operative state that permits communication with the exterior, and a conduit providing a flow path from the second port to the diagnostic member, the method comprising:

locating the diagnostic member distally spaced from the hollow, above a top-most surface of the valve;

sealing the first chamber from the second chamber with the metering member; and measuring a flow through the first chamber of the valve.

39. The method according to claim 38, wherein measuring comprises measuring the flow through the second port.

40. The method according to claim 39, wherein measuring comprises measuring the flow through the diagnostic member.

41. The method according to claim 40, wherein the diagnostic member comprises a check valve.

42. The method according to claim 41, further comprising:

comparing the measured flow to a predetermined flow rate to determine the presence of a leak.

* * * * *